United States Patent [19]

Coulter

[11] Patent Number: 4,614,099

[45] Date of Patent: Sep. 30, 1986

[54] ROLLING MILL

[75] Inventor: Leland E. Coulter, New Canaan, Conn.

[73] Assignee: Teledyne, Inc., New Canaan, Conn.

[21] Appl. No.: 635,055

[22] Filed: Jul. 27, 1984

[51] Int. Cl.[4] ..... B21B 37/06; B21B 35/00

[52] U.S. Cl. ..... 72/29; 72/245; 72/249

[58] Field of Search ..... 72/249, 241, 245, 29; 318/66, 67, 68, 77, 78

[56] References Cited

U.S. PATENT DOCUMENTS

| | | | |
|---|---|---|---|
| 1,558,633 | 10/1925 | Rockwell | 72/249 |
| 1,988,033 | 1/1935 | Chandler | 72/249 |
| 2,181,173 | 11/1939 | Catulle | 72/248 |
| 2,752,803 | 7/1956 | Antrim | 72/29 |
| 3,030,836 | 4/1962 | Gochenour | 72/249 |
| 3,298,212 | 1/1967 | Cook | 72/249 |
| 3,518,859 | 7/1970 | Brinkeborn | 72/249 |
| 3,605,474 | 9/1971 | Lhenry | 72/249 |
| 4,152,912 | 5/1979 | Shiozaki et al. | 72/249 |
| 4,212,504 | 7/1980 | Krylov et al. | 72/241 |
| 4,218,907 | 8/1980 | Ruhl | 72/241 |
| 4,271,379 | 6/1981 | Eckelmeyer | 318/78 |
| 4,365,496 | 12/1982 | Shiozaki et al. | 72/249 |
| 4,438,376 | 3/1984 | Varnovitsky | 318/78 |

FOREIGN PATENT DOCUMENTS

| | | | |
|---|---|---|---|
| 68516 | 6/1981 | Japan | 72/249 |
| 999238 | 7/1965 | United Kingdom | 72/249 |

*Primary Examiner*—Francis S. Husar
*Assistant Examiner*—Jorji M. Griffin
*Attorney, Agent, or Firm*—St. Onge Steward Johnston & Reens

[57] ABSTRACT

Upper and lower reducing rolls are mounted within a mill housing for rotation about their axes and for parallel movement. Actuating cylinders force the upper reducing roll downward toward the lower reducing roll to effect a separation force on a workpiece that is placed therebetween. Four direct drive motors, one directly coupled to each end of the upper and lower reducing rolls, counter-rotate the reducing rolls to drive the workpiece therebetween. The motors are synchronized within a close tolerance of a set speed to prevent torsion of one end of the reducing rolls relative to the opposite end. Preferably, the rolling mill includes closely enclosed backing rolls engaging the reducing rolls to prevent deflection of the reducing rolls under load. This allows the rolling mill to produce a flat workpiece over a wide range of separation forces by means of cylindrical reducing rolls. The rolling mill is particularly suited for specialized rolling because it maintains the crystal structure of the workpiece and permits greater separation forces to be applied than with other rolling mills.

17 Claims, 5 Drawing Figures

ROLLING MILL

BACKGROUND OF THE INVENTION

This invention relates to rolling mills for rolling sheet, plate, and the like. More particularly, the invention relates to rolling mills for rolling relatively thick workpieces of composites or special steel alloys such as, for example, alloys used for armor plate.

In the rolling of special steel alloys, a very high pressure must be exerted upon the workpiece by the reducing rolls of a rolling mill. This pressure, generally measured in terms of the separation force of the reducing rolls, may be required to be in the millions of pounds, depending upon the particular alloy, the thickness and width of the workpiece, the configuration of the reducing rolls, and the number of passages used to effect a given reduction in thickness of the workpiece. As more sophisticated alloys have been developed with increased strength and toughness, there has been a growing need for rolling mills of greater pressure capacity.

One of the difficulties in scaling up present rolling mills to increase pressure capacity is related to the configuration of the reducing rolls. To allow for the deflection of the reducing rolls under pressure, the reducing rolls of conventional rolling mills are formed with a crown; the reducing rolls have a smaller diameter at their ends than at their intermediate points. Such reducing rolls are designed to deflect to a uniform spacing only at a single separation force; any other separation force will result in too much or too little deflection of the reducing rolls, causing the workpiece to have a nonuniform thickness.

Another difficulty in producing a rolling mill of increased pressure capacity suitable for special alloys is related to the drive means. Generally, the reducing rolls of conventional rolling mills are driven by stationary motors connected to the reducing rolls by drive shafts having universal joints. The reducing rolls may be geared together or otherwise synchronized to ensure similar rotating speeds. Examples of such drive means are the rolling mills disclosed in U.S. Pat. No. 2,752,803 (Antrim), U.S. Pat. No. 3,605,474 (Lhenry), and U.S. Pat. No. 4,152,912 (Shiozaki et al).

The universal joints of the drive means of these conventional rolling mills cause oscillations in the rotataional speed of the reducing rolls, and the backlash of the gears and the twisting of the reducing rolls aggravate these oscillations in the rotational speed. Even if small, such variations may prove significant in the rolling of special alloys, particularly when a rolling mill is scaled up to handle relatively large workpieces. Other difficulties result from slight variations between the rotational speeds of the upper and lower reducing rolls.

To maintain maximum strength and toughness, great care must be directed to maintaining the metallurgical integrity of special alloys. If the upper and lower reducing rollsare not both rotated at precisely the same speed along their full operating length, such variations, even if small, will cause slippage or disturb the crystal structure at the surface, reducing the suitability of the workpiece for particular uses, such as, for example, armor plate. A technique known as "warm rolling", in which the temperature of the workpiece is relatively low but above the temperature of cold rolling, is of some help in maintaining the metallurgical integrity of special alloys.

Similarly, there is a need for a rolling mill of larger pressure capacity for hot or cold rolling of super alloys that are particularly difficult to work. Larger capacity rolling mills are also required to achieve deeper penetration of the metallurgical structure of a workpiece during the rolling and for decreasing the number of passes required to effect a given reduction in thickness or other change of shape of a workpiece during form rolling. Also, larger capacity rolling mills are required for the rolling of composite and metal laminates.

Accordingly, it is an object of the present invention to provide a rolling mill having increased capacity, as measured in terms of the separation force, suitable for rolling relatively large workpieces made of special alloys, composites and metal laminates.

it is a further object of the present invention to provide a rolling mill capable of reducing a workpiece to a uniform thickness over a wide range of separation forces rather than at a single separation force.

It is still a further object of the present invention to provide a rolling mill with improved uniformity of rotational speeds of the upper and lower reducing rolls along their full operating lengths so as to prevent slippage and maintain the metallurgical integrity of a workpiece.

SUMMARY OF THE INVENTION

The present invention is directed to a rolling mill for reducing the thickness or otherwise changing the shape of a workpiece. Upper and lower reducing rolls are mounted within a mill housing so as to be rotatable about their axes and movable with respect to each other in parallel relation. Actuating means is provided to force the upper reducing roll downward toward the lower reducing roll to effect a separation force of the workpiece that is placed therebetween.

Four direct drive motors, one of which is directly coupled to each end of the upper and lower reducing rolls, are provided for counter-rotating the reducing rolls to drive the workpiece therebetween. Synchronizing means is provided for synchronizing each of the motors within a close tolerance of a set speed for preventing torsion of one end of the reducing rolls relative to the opposite end, thereby maintaining metallurgical integrity of the workpiece during rolling. Preferably, the synchronization means includes an optical encoder connected to each motor, a master clock, and control means, for varying the voltage to each motor to synchronize pulses from the motor encoders with pulses from the master clock.

According to one aspect of the present invention, the speed of the paired drive motors on each reducing roll can be set independently, so that each reducing roll can rotate at a slightly different speed. This allows the surface velocity of each reducing roll to be made identical, thereby reducing slippage to an insignificant amount by compensating for measured differences in the actual diameter of the reducing rolls. The master clock can be used to generate slightly different predetermined pulse frequencies for each reducing roll to achieve the desired slightly different rotational speeds.

According to another aspect of the present invention, the rolling mill is provided with backing rolls in engagement with the reducing rolls to prevent deflection of the reducing rolls under load. Preferably, each of the backing rolls is cylindrical and is closely held within a bearing extending substantially the full length of the backing roll. This allows the reducing rolls to be cylindrical rather than crowned and permits the rolling mill to produce a flat workpiece of uniform thickness regardless of the extent of the separation force applied by the reducing rolls.

The rolling mill of the present invention is particularly suited for specialized rolling, such as that of special armor plate, to provide improved surface characteristics by increasing the depth of penetration of the workpiece and by reducing stretching to maintain the crystal structure at the surface of the workpiece. Furthermore, the rolling mill of the present invention permits greater pressure, measured as the separation force, to be applied to the workpiece than with other rolling mills. This increased separation force facilitates the rolling of larger workpieces and of workpieces made of composites and supper alloys.

The invention, together with further objects and attendant advantages, will be best understood by reference to the following detailed description of the preferred embodiment taken in conjunction with the following drawings.

DETAILED DESCRIPTION OF THE PREFERRED EMBODIMENT

Figure 1:
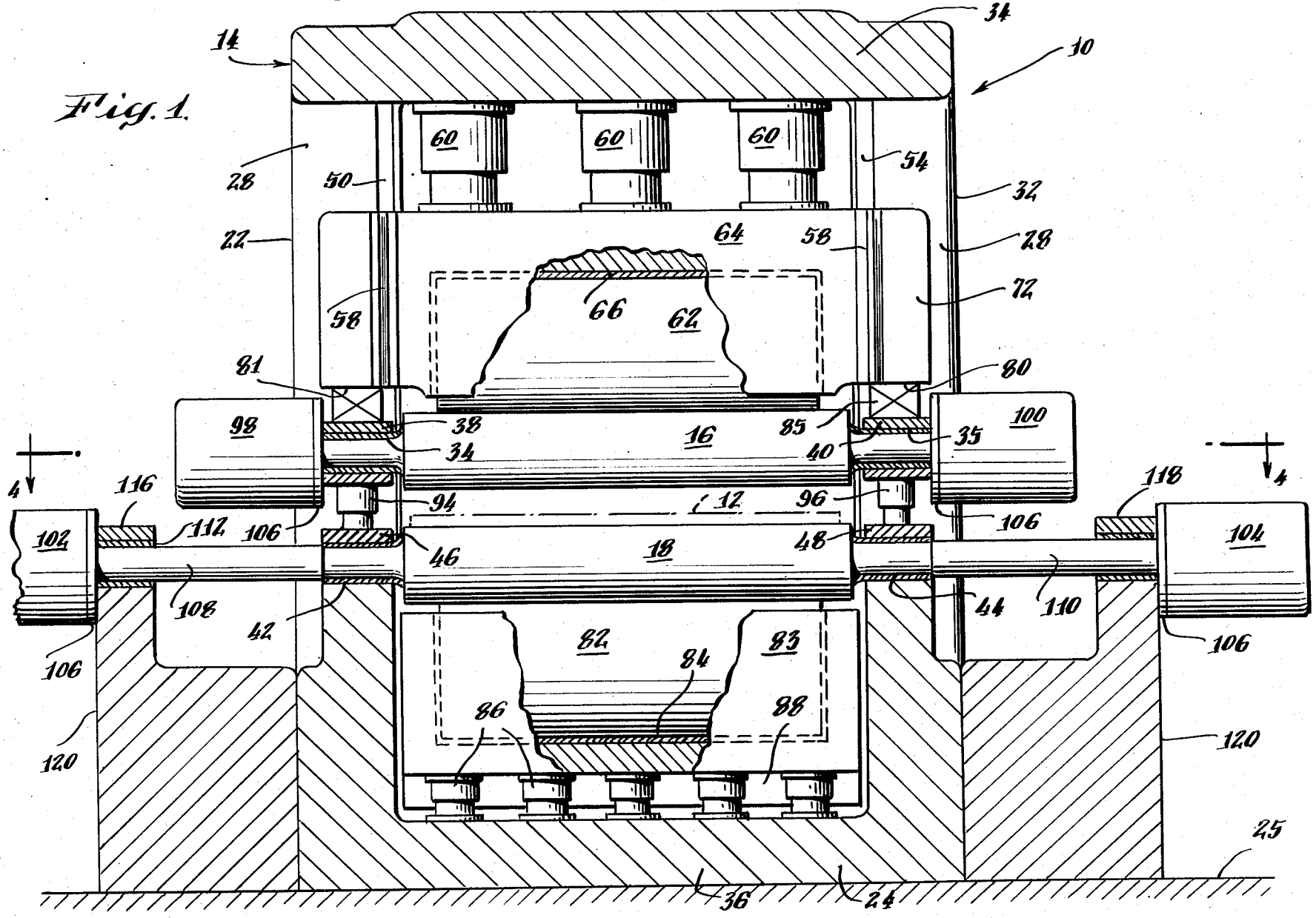
FIG. 1 is a front elevational view of a rolling mill made in accordance with the present invention with portions broken away.
Figure 2:
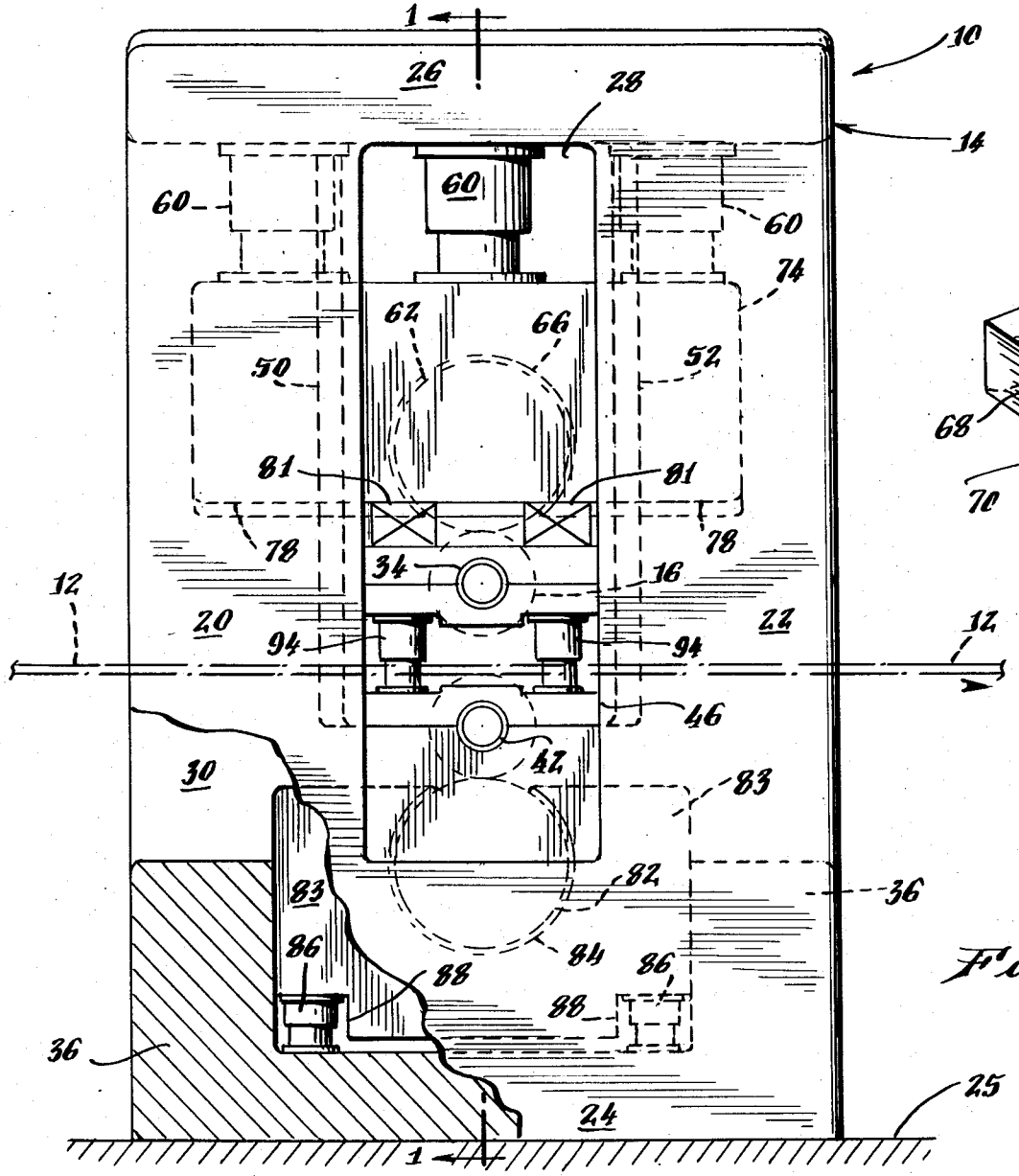
FIG. 2 is a side elevational view of the rolling mill of FIG. 1 with portions broken away.
Figure 4:
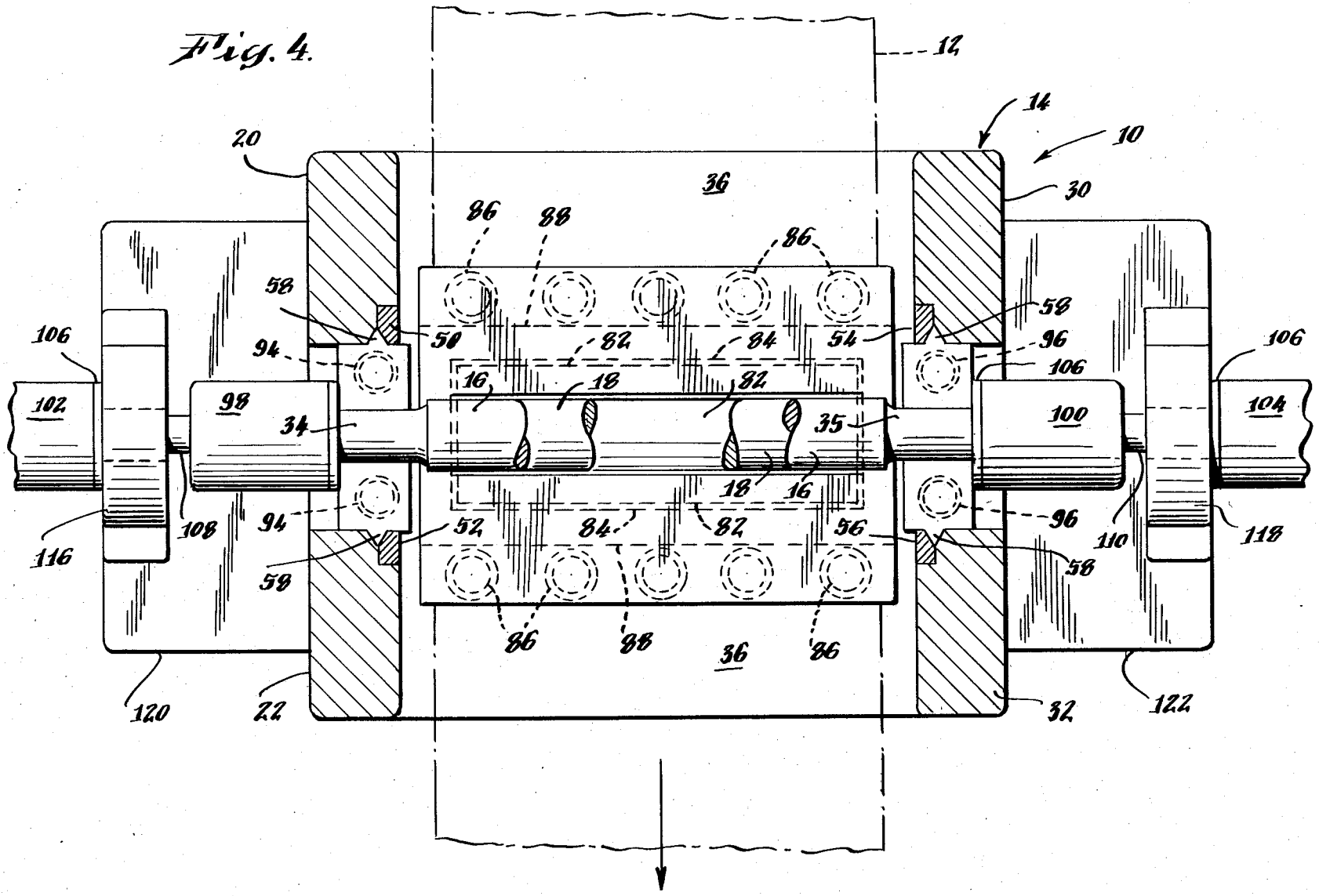
FIG. 4 is a sectional view of the rolling mill of FIG. 1 taken along the line 4—4 of FIG. 1.

Turning now to the drawings, FIGS. 1, 2 and 4 show a rolling mill, indicated generally by the numeral 10, made in accordance with the present invention for reducing the thickness of a workpiece, indicated in phantom by the numeral 12. The rolling mill 10 includes a mill housing, indicated generally by the numeral 14, providing support for upper and lower reducing rolls 16 and 18, respectively.

As best shown in FIG. 2, the mill housing 14 has a substantially rectangular end structure comprising a rear corner post 20 and a front corner post 22 joined by a lower connecting member 24, upon a floor 25, and an upper connecting member 26. This particular configuration leaves a vertical and substantially rectangular mill housing window 28 within which the upper and lower reducing rolls 16 and 18 are mounted. Similar rear and front corner posts 30 and 32 form the opposite (or right-hand) end structure of the mill housing 14, as shown in FIG. 4. An upper bridging member 34 and a lower bridging member (or base) 36 form a rigid box-like strucutre, as indicated in FIGS. 1, 2 and 4.

Due to the large size of the structure, the mill housing 14 is made of several sections rather than being cast or otherwise formed as a single piece or unit. For simplicity of explanation, the mill housing 14 is shown as a single rigid structure, it being understood that the structure is made of several sections joined by conventional means. For example, the upper and lower bridging members 34 and 36 may include tenons for engaging openings or mortises within the lower and upper connecting members 24 and 26, such bridging members being secured by tie-rods joining the front corner posts 22 and 32 and by tie-rods joining the rear corner posts 20 and 30.

The upper reducing roll 16 is journaled within bearing assembles 34 and 35 that are supported within upper reducing roll bearing housing 38 and 40, respectfully. Similarly, the lower reducing roll 18 is journaled within bearing assemblies 42 and 44 that are supported within lower reducing roll bearing housings 46 and 48, respectively. As indicated in FIGS. 1 and 2, the bearing housings 38, 40, 46 and 48 are formed of two portions joined at a horizontal parting line along the diameters of the upper and lower reducing rolls 16 and 18 to facilitate access to the respective bearing assemblies for assembly and maintenance.

The corner posts 20, 22, 30 and 32 are provided with retainer members 50, 52, 54 and 56, respectively, to form V-shaped channels for engagement with the upper and lower bearing housings 38, 40, 46 and 48, as shown in FIG. 4. In the preferred embodiment shown, the bearing housings have outwardly extending V-shaped shoulders 58 to be received in the channels of the respective corner posts for guided movement. It will be appreciated that other guide means may be employed to provide the controlled vertical movement of the reducing rolls while maintaining their parallel relationship.

As shown in FIGS. 1 and 2, the upper reducing rolls 16 is forced downward toward the lower reducing roll 18 by several large fluid cylinders 60. A substantial portion of the force of the fluid cylinders 60 is applied through the upper bearing housings 38 and 40, as described below, but it is preferred that at least a portion of the downward force of the fluid cylinders 60 is applied to the upper reducing roll 16 through an upper backing roll 62. In this manner, the upper reducing roll 16 can be prevented from bending away from the workpiece 12 when the fluid cylinders apply a large separation force.

Preferably, the upper backing roll 62 is captured within a closely fitting upper backing roll support member, indicated generally by the numeral 64, such that only a narrow longitudinal surface is exposed, as show in FIGS. 1 and 2. As shown pictorially in FIG. 3, a bushing 66 or other low friction liner is provided within the support member 64 along the full length of the upper backing roll 16. For example, the bushing 66 may be a 0.001–0.002 inch thickness of sliver. The support member 64 may be formed of multiple pieced to facilitate mounting of the upper backing roll 16 therein during assembly. Alternatively, the backing roll may be mounted from one end of the support member 64.

The support member 64 for the upper backing roll 62 has V-shaped shoulders 68 to be received in the channels of the corner posts 20, 22, 30 and 32, or has other guiding means for providing guided vertical movement of the upper backing roll 62. The support member 64 may extend longitudinally with respect to the upper backing roll 62 to form rectangular ends 70 for guided movement within the housing windows 28 and may extend laterally with respect to the upper backing roll 62 to form horizontal surfaces 74 and 76 for mounting of additional fluid cylinders 60 to increase the downward force on the support member 64.

Preferably, the ends 70 and 72 of the support member 64 have their surfaces cut away at numerals 78 and 80 to permit the upper reducing roll 16 to be resurfaced several times, thereby reducing its diameter, without resulting in interference between the backing roll support member 64 and the upper reducing roll bearing housings 38 and 40. To distribute a substantial fraction of the downward force of the fluid cylinders 60 directly to the upper reducing roll 16, gibs or other adjustable spacer means, indicated at 81 and 85, is provided between the surfaces 78 and 80 of the support member 64 and the upper reducing roll bearing housings 38 and 40, respectively. Alternatively, compression springs could be employed in place of or in addition to the adjustable spacer means 81 and 85.

The lower reducing roll 18 is similarly backed by a lower backing roll 82, captured within a lower backing roll support member 83. As with the upper backing roll 62, the lower backing roll support member 83 has a bushing 84 or other low friction liner, and only a narrow longitudinal surface of the lower backing roll 82 is exposed. The support member 83 may be formed of more than one piece to facilitate access to the lower backing roll 82 for assembly and maintenance. The support member 83 is mounted within the lower bridging member 36 for guided vertical movement of the lower backing roll 82 into engagement with the lower reducing roll 18.

In the preferred embodiment, upward movement of the lower backing roll 82 is provided by fluid cylinders 86 positioned within channels 88 of the lower backing roll support member 83 in engagement with the lower bridging member 36. Valving means, not shown, is employed to ensure that the lower backing roll 82 is forced upward by the fluid cylinders 86 in an even manner and with sufficient force to prevent deflection of the lower reducing roll 18. This mounting of the support member 83 provides automatic positioning of the lower backing roll 82, allowing for regrinding of the lower reducing roll 18 to correct for wear.

Figure 3:
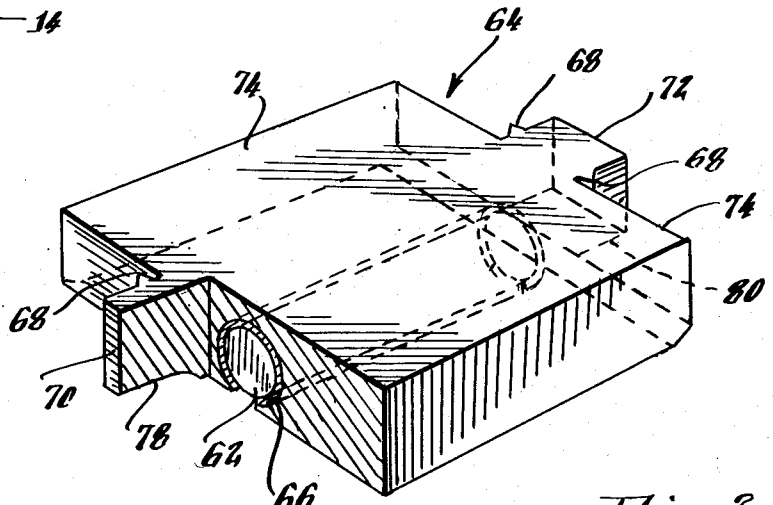
FIG. 3 is a perspective view of the upper backing roll support member of the rolling mill of FIG. 1, with portions broken away.

The lower reducing roll bearing housings 46 and 48 are fixed relative to the mill housing 14. As shown in FIGS. 1 and 3, the lower halves of the bearing housings 46 and 48 may be formed integrally with the lower connecting member 24. The upper halves of the bearing housings 46 and 48 are joined to the lower halves by bolts or other conventional means. Axial retention of the upper halves of the bearing housings 46 and 48 may be provided by V-shaped shoulders similar to those of the upper reducing roll bearing housings 38 and 40 to be received in the channels of the corner posts 20, 22, 30, and 32.

Alternatively, the lower backing roll 18 may be fixed with respect to the mill housing 14, and the lower reducing roll 82 may be movable within the mill housing 14 so as to be in engagement with the lower reducing roll 18. With that configuration, the lower reducing roll bearing housings 46 and 48 can include V-shaped shoulders for guided vertical movement within the channels of the corner posts 20, 22, 30, and 32, similar to the upper reducing roll bearing housings 38 and 40. Preferably, the upper and lower reducing rolls 16 and 18 are of smaller diameter than the upper and lower backing rolls 62 and 82 to reduce the pressure and wear on the bushings 66 and 84.

Flui cylinders 94 and 96 are placed in pairs between the reducing roll bearing housings 38, 40, 46 and 48 to cause spreading of the upper and lower reducing rolls 16 and 18 between rolling operations. Alternatively, or in addition to the fluid cylinders 94 and 96, the fluid cylinders 60 may be "double acting" to provide lifting of the upper backing roll support member 64 as well as lowering of that member. If the fluid cylinders 60 are relied upon for spreading of the upper and lower reducing rolls 16 and 18, connecting means is provided between the upper backing roll support member 64 and the upper reducing roll bearing housings 38 and 40 to ensure lifting as a unit.

It is a particular feature of the present invention that the upper and lower reducing rolls 16 and 18 are rotated by four direct drive direct current (DC) motors 98, 100, 102 and 104, one at each end of each reducing roll, mounted upon the respective bearing housings by suitable means such as, for example, by flanges 106. Each of the drive motors is slaved together so as to run within a very close tolerance of a set speed. This synchronization ensures that the rate of rotation of each end of each reducing roll is precisely the same, thereby minimizing torsion of the reducing rolls 16 and 18.

Although the motors 102 and 104 directly connected to the lower reducing roll 18 may be conveniently mounted on the bearing housings 46 and 48 so as to be directly below the motors 98 and 100, it will be appreciated from FIG. 1 that, in that case, the diameter of the motors is limited by the diameter of the reducing rolls and the thickness of the workpiece. For that reason, it is preferred that the lower reducing roll 18 is extended outward as drive shafts 108 and 110, which are journaled within bearing assemblies 112 and 114 and supported by reducing roll bearing housings 116 and 118. To provide the lower halves of the bearing housings 116 and 118, housing extensions 120 and 122 are joined to the mill housing 14.

Preferably, the fluid cylinders 60 are provided with a manifold and valving means for controlling the separation force between the upper and lower reducing rolls 16 and 18. This valving means can be used to effect a uniform spacing along the full lengths of the reducing rolls so as to result in a uniform thickness of a completed workpiece regardless of a lack of uniformity in the thickness of the initial workpiece. For example, if a metal plate having a thicker edge and an opposite thinner edge is fed into the rolling mill 10, the fluid cylinders 60 can be controlled to exert a greater separation force at the thicker edge of the workpiece to eliminate the variation in thickness.

Figure 5:
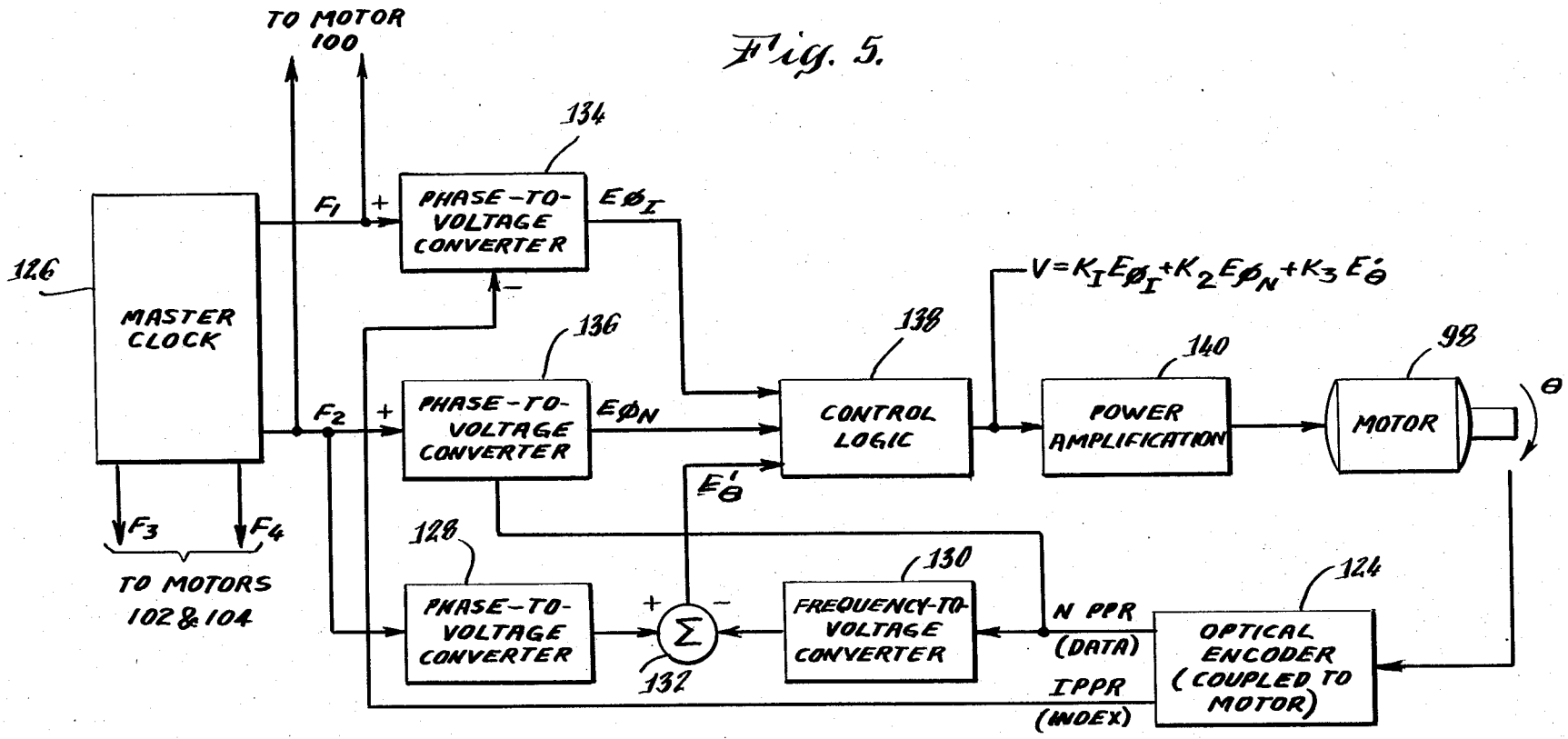
FIG. 5 is a schematic diagram showing the control system for synchronizing the motors of the rolling mill of FIGS. 1–4.

The control system for synchronizing the motors 98, 100, 102 and 104 is shown in FIG. 5. Each motor is fitted with an optical encoder 124 that generates a large number of data pulses per revolution (typically 10,000) indicated as N PPR, and a single index pulse per revolution indicated as I PPR, on separate output lines. The control system adjusts the voltage to each motor so as to maintain the data pulses and index pulses of the encoders 124 in synchronization with data pulses and index pulses coming the from a master clock 126.

Preferably, the absolute rotational phase relationship between the motors is achieved by synchronizing the once per revolution index pulses I PPR from the encoders 124 with index pulses $F_1$ from the master clock 126. Alternatively, the index pulses $F_1$ for each motor from the master clock 126 can be offset from one another by a predetermined fixed amout, so that each motor can have a particular angular offset with respect to the other motors, if desired. In particular, the master clock 126 can provide index pulses $F_1$ to the motors 98 and 100 at a predetermined rate different from that of index pulses $F_3$ provided to the motors 102 and 104. This allows the surface velocities of the upper and lower reducing rolls 16 and 18 to be made identical, even though the actual measured diameters of the reducing rolls are not exactly the same.

For example, the radius of the reducing roll 16 may be 10.005 inches and the radius of the reducing roll 18 may be 10.000 inches, due to wear and regrinding or manufacturing tolerances. The master clock 126 can be set to produce 10,000×10,005 pulses per revolution, typically corresponding to 30 seconds, and index pulses $F_1$ and $F_3$ can be generated by counters at 10,000 cycles per 30 seconds and 10,005 cycles per 30 seconds, respectively. This ensures that the surface velocities of the upper and lower reducing rolls 16 and 18 are identical, thereby eliminating slippage of either roll.

There are three operational modes for the control system of FIG. 5. During a "startup" mode, the control system brings each motor up to speed, without regard to phase, using a conventional tachometer-based control approach. A phase-to-voltage converter 128 and a frequency-to-voltage converter 130 produce voltages proportional to the rates of the pulses $F_2$ from the master clock 126 and the rates of the pulses N PPR from the encloder 124, respectively, and feed those voltages to a conventional servo mechanism 132. The servo mechanism 132 subtracts the voltage of the converter 130 from the voltage of the converter 128 to produce an error signal $E\dot{\theta}$ that is to be minimized.

Once up to nominal speed, during a "homing" mode the speed of each motor is adjusted very gradually to bring the index pulses I PPR around until they are synchronized with the index pulses $F_1$ of the master clock 126. A phase-to-voltage converter 134 measures the time of arrival of the index pulses I PPR from the encoder 124 relative to the time of arrival of the index pulses $F_1$ from the master clock 126 to produce an error signal $E\phi_I$. The error signal $E\phi_I$ is minimized by adjusting the DC voltage to the respective motor until the error signal $E\phi_I$ is within a predetermined tolerance of zero, indicating that the desired rotational speed and phase of the respective motor have been obtained.

Once the index pulse is within a desired tolerance of the $F_1$ pulse, the voltage to the particular motor is further adjusted during a "lock-in" mode to maintain the data pulses N PPR of the encoder 124 in synchronization with data pulses of the master clock 126, designated as $F_2$. A phase-to-voltage converter 136 similar to the converter 136 measures the time of arrival of the respective pulses and produces an error signal $E\phi_I$ that is minimized by adjusting the DC voltage to the respective motor. Each of the error signals, $E\phi_I$, $E\phi_N$, and $E\dot{\theta}$ is supplied to a control logic module 138 that recognizes the operating mode of the control system and produces a combined error function V, indicated in FIG. 5, with system gain constants $K_1$, $K_2$ and $K_3$ weighting the respective error signals. The control logic module 138 can be a conventional microprocessor or other analog or digital electronics.

During the startup mode, the control logic module 138 sets the gain constants $K_1$ and $K_2$ small and the constants K3 large, allowing the error signals $E\phi_I$ and $E\phi_N$ to vary widely while the error signal $E\dot{\theta}$ is minimized. During the homing mode the gain constant $K_1$ is made large, the gain constant $K_2$ small, and the gain constants $K_3$ intermediate those values to allow the rotational speed to vary slightly while the phase is brought roughly into synchronization. During the lock-in mode, the gain constants $K_1$ and $K_2$ are made large and the gain constant $K_3$ somewhat less to provide a fine adjustment of the phase synchronization. Each of the motors 98, 100, 102, and 104 is controlled by the same control logic algorithm by means of conventional power amplification hardware 140 to increase or decrease their respective rotational speeds.

It should be apparent that the rolling mill 10 of the present invention may be scaled upward to accommodate workpieces of a greater size and to apply greater separation forces than is possible with current rolling mills. Because the reducing rolls 16 and 18 are driven directly from both ends by four different motors, twisting of the reducing rolls is significantly reduced, particularly under heavy loading. And, the combination of the fluid cylinders 60 and the backing rolls 62 and 82 maintains uniform pressure and spacing along the lengths of the reducing rolls 16 and 18, regardless of the size of the rolling mill 10.

As an example of the utility of this invention, the reducing rolls 16 and 18 may be 62 inches long and have a working diameter of 24 to 48 inches. The fluid cylinders 60, acting through the upper bearing support members 38 and 40 and the upper backing roll 62, may exert pressures of 20 million pounds or more, measured as the separation force of the reducing rolls 16 and 18. In contrast, the largest rolling mills available with conventional configurations achieve only 10 to 12 million pounds pressure, measured as the separation force of the reducing rolls.

A rolling mill of the size described above is particularly suitable for warm rolling 5-foot wide special alloy plate at a preferred temperature range of 800° to 900° F. to form armor plate. Suitable motors 98, 100, 102 and 104 are flange type, compound wound 500 hp motors with variable speeds of ½ to 100 rpm. Typically, the rolling mill 10 operates with the motors turning the reducing rolls within a range of zero to 5 rpm, the rotational speeds of the backing rolls being proportionally lower due to their larger diameters.

It should also be apparent that the rolling mill of the present invention is capable of reducing a workpiece to a uniform thickness over a wide range of separation forces. Unlike rolling mills employing crowned reducing rolls that present a cylindrical surface to the workpiece only at a single spearation force, the reducing rolls 16 and 18 are cylindrical. This cylindrical configuration is made possible by the backing rolls 62 and 82 that are supported along their full length by the upper backing roll support member 64 and the lower backing roll support member 83, respectively, that ensure that the upper and lower reducing rolls 16 and 18 remain parallel.

Further, it should be apparent that the elimination of universal joints and the elimination of gearing of the drive means result in substantially oscillation-free and backlash-free rotation of the reducing rolls. The synchronization control system ensures that the four individual motors drive the ends of each reducing roll at precisely the same uniform speed to minimize stretching of the metallurgical structure. For those reasons, the rolling mill of the present invention can roll special alloys from an ingot to a plate or sheet with a minimum of disturbance of the metallurgical integrity of the workpiece, thereby improving the strength, toughness, and other physical properties of the armor plate or other article of manufacture being formed.

The rolling mill 10 of the present invention also provides significant advantages for hot and cold rolling. For example, super alloys that retain their strength when heated to near melting temperature can be more efficiently rolled hot rather than warm. The increased separation forces provided by the present invention allow such difficult alloys to be rolled to a predetermined thickness with fewer passes and with a corresponding greater depth of penetration of the metallurgical structure. Cooling of the reducing rolls, either by an external spray or by internal coils may be provided as required.

Other advantages result when the present invention is applied to the cold rolling of various workpieces. It will be appreciated that the greater pressures may be employed to cause a desired work-hardening of the surface of a workpiece to a predetermined depth. Also, the rolling mill 10 may be employed to roll various composites and metal laminates to effect bonding. For example, layers of caramic material and steel may be pressed together with sufficient force by the rolling mill 10 to bond the adjacent layers together.

The rolling mill 10 is normally operated as a reversing mill. The control system of FIG. 5 is particularly suited to such operation because of its ability to bring the motors 98, 100, 102 and 104 from a stopped condition to a fully synchronized working rotational speed within a short period of time and because the DC power facilitates reversal of rotational direction of the rolls. Successive passes of a workpiece through the rolling mill 10 can be made more rapidly to improve productivity.

Although the rolling mill of the present invention has been described primarily with respect to the rolling of sheet or plate, it should be apparent that the rolling mill may be used for form folling. For example, a workpiece of square cross-section may be progressively rolled to form a rod of round cross-section, to form an I-beam, or to form various other products. In such applications, the reducing rolls may have several non-cylindrical regions, spaced longitudinally thereon to provide work stations for successive passes of a workpiece.

It should be understood that various changes and modifications to the preferred embodiment described above will be apparent to those skilled in the art. Such changes and modifications can be made without departing from the spirit and scope of the present invention, and it is therefore intended that such changes and modifications be covered by the following claims.

What is claimed is:

1. A rolling mill, comprising:

a mill housing;

a lower reducing roll mounted within the mill housing for rotation about its axis;

an upper reducing roll mounted within the mill housing for rotation about its axis such that the upper reducing roll is movable toward and away from the lower reducing roll and in parallel relation thereto;

actuating means for selectively forcing the upper reducing roll downward toward the lower reducing roll, to effect a separation force on the workpiece placed therebetween;

four direct drive electric motors, connected to the respective ends of the upper and lower reducing rolls, such that each reducing roll is directly driven by one of the motors at each end, for counter-rotating the upper and lower reducing rolls to drive the workpiece therebetween; and synchronizing means for synchronizing each of the four direct drive motors within a close tolerance of a set speed for maintaining one end of each reducing roll at substantially the same speed as the opposite end thereof, thereby preventing torsion of said one end relative to said opposite end thereof.

2. The rolling mill of claim 1 further comprising upper and lower backing rolls mounted within the mill housing parallel to the upper and lower reducing rolls, respectively, above and below the upper and lower reducing rolls and engageable therewith so as to reduce deflection of the reducing rolls upon engagement with the workpiece.

3. The rolling mill of claim 2 further comprising backing roll support means extending along substantially the full length of each of the backing rolls to prevent deflection of the backing rolls upon engagement with the reducing rolls.

4. The rolling mill of claim 2 wherein the upper and lower reducing rolls have a cylindrical working surface so as to provide a uniform distance between the upper and lower reducing rolls along their full working lengths regardless of the separation force between the reducing rolls.

5. The rolling mill of claim 2 wherein the actuating means acts through the upper backing roll as well as through the upper reducing roll so as to distribute a substantial portion of the downward force therethrough, so as to provide a large separation force without causing deflection of the upper reducing roll.

6. A rolling mill for reducing the thickness of a workpiece, comprising:

a mill housing a cylindrical lower reducing roll journaled for rotation about its axis of the mill housing;

a cylindrical upper reducing roll journaled for rotation about its axis and mounted for guided vertical movement within the mill housing, such that the upper reducing roll is parallel to the lower reducing roll and movable to engage the workpiece between the upper and lower reducing rolls;

a cylindrical upper backing roll parallel to the upper reducing roll, substantially enclosed so as to be closely supported along its length and engageable with the upper reducing roll;

a cylindrical lower backing roll parallel to the lower reducing roll, substantially enclosed so as to be closely supported along its length and engageable with the lower reducing roll;

fluid actuating means for selectively forcing the upper reducing roll downward toward the lower reducing roll to effect a variable separation force therebetween, at least a portion of the force being carried by the upper and lower backing rolls for preventing deflection of the upper and lower reducing rolls, respectively;

four direct drive DC motors, one mounted upon each end of the upper reducing roll and one mounted upon each end of the lower reducing roll, directly connected thereto for counterrotating the reducing rolls to drive the workpiece therebetween; and synchronizing means for synchronizing each of the four direct drive DC motors within a close tolerance of a set speed for maintaining one end of each reducing roll at substantially the same speed as the opposite end thereof, thereby preventing torsion of said one end relative to said opposite end and for maintaining similar surface speeds of the upper and lower reducing rolls.

7. The rolling mill of claim 6 wherein each end of the upper reducing roll is journaled in a support member in sliding engagement with the mill housing and wherein one of the motors is mounted on each support member for driving the upper reducing roll.

8. The rolling mill of claim 6 wherein the lower reducing roll is extended longitudinally from its working surface beyond the motors connected to the upper reducing roll for connection to the other two motors that the motors connected to the lower reducing roll are displaced outward relative to the motors connected to the upper reducing roll to facilitate the use of larger motors.

9. The rolling mill of claim 6 further comprising second fluid actuating means for forcing the lower backing roll upward against the lower reducing roll to prevent deflection of the lower reducing roll upon engagement with a workpiece.

10. The rolling mill of claim 6 wherein the fluid actuating means comprises a plurality of fluid cylinders distributed longitudinally with respect to the upper reducing roll and wherein the rolling mill further comprises distributing means for distributing fluid between the fluid cylinders so as to permit a variation in separation force along the length of the upper reducing roll.

11. A rolling mill for reducing the thickness of a workpiece, comprising:

a mill housing;

upper and lower reducing rolls mounted within the mill housing for rotation about their axes and for movement toward each other to engage the workpiece therebetween;

actuating means for selectively forcing the upper reducing roll downward toward the lower reducing roll to effect a separation force on the workpiece placed therebetween;

four DC motors, one of which is directly connected to each end of each of the upper and lower reducing rolls for counter-rotating the upper and lower reducing rolls to drive the workpiece therebetween;

an optical encoder connected to each motor for producing a predetermined number of data pulses per revolution;

a master clock for producing pulses at a predetermined frequency corresponding to a desired rotational speed of the reducing rolls; and control means for adjusting the voltage to at least one of the motors so as to achieve and maintain synchronization of the encoder pulses with the master clock pulses within a close tolerance for establishing and maintaining synchronization of the rotational speed of each motor and their associated driven rolls for maintaining one end of each reducing roll at substantially the same speed as the opposite end thereof, thereby reducing torsion of the said one end relative to said opposite end thereof.

12. The rolling mill of claim 11 further comprising upper and lower backing rolls mounted within the mill housing parallel to the upper and lower reducing rolls, respectively, above and below the upper and lower reducing rolls and engageable therewith so as to reduce deflection of the reducing rolls upon engagement with the workpiece.

13. The rolling mill of claim 11 wherein the optical encoder of each motor is further operable to produce a motor index pulse once per revolution of the motor on an output line separate from the data pulses, wherein the master clock is further operable to produce clock index pulses, and wherein the control means is operable to adjust the voltage to at least one of the motors to synchronize the phase of the reducing rolls by synchronizing the motor index pulses and the clock index pulses.

14. The rolling mill of claim 13 wherein the control means is further operable to bring the upper and lower reducing rolls from a stopped condition to a predetermined rotational speed during a first operating mode and to bring the upper and lower reducing rolls from an out-of-phase condition to an in-phase condition during a second operating mode.

15. The rolling mill of claim 14 further comprising at least one phase-to-voltage converter for generating an error signal indicating the out-of-phase condition, and power amplification means for amplifying the error signal to facilitate adjustment of the respective motor to reduce the error signal.

16. The rolling mill of claim 11 wherein the control means is further operable to compensate for differences between the diameters of the upper and lower reducing rolls by causing a proportionally slower rotation of the larger reducing roll to effect equal surface speeds of the upper and lower reducing rolls.

17. The rolling mill of claim 16 wherein the master clock is operable to produce pulses at a first pulse rate for the motors driving the upper reducing roll and to produce pulses at a second pulse rate for the motors driving the lower reducing roll, the first and second pulse rates being predetermined in reverse proportion to the diameters of the respective reducing rolls.

* * * * *